US007210580B2

(12) United States Patent
Elliott

(10) Patent No.: US 7,210,580 B2
(45) Date of Patent: May 1, 2007

(54) DISPENSING CONTAINERS

(75) Inventor: Howard Elliott, Stratford on Avon (GB)

(73) Assignee: Future Technology (UK) Ltd, Oxfordshire (GB)

( * ) Notice: Subject to any disclaimer, the term of this patent is extended or adjusted under 35 U.S.C. 154(b) by 254 days.

(21) Appl. No.: 10/695,619

(22) Filed: Oct. 28, 2003

(65) Prior Publication Data

US 2005/0087472 A1 Apr. 28, 2005

(51) Int. Cl.
*B65D 83/04* (2006.01)

(52) U.S. Cl. ..... 206/538; 206/528

(58) Field of Classification Search ..... 206/531, 206/532, 538, 469, 461, 471, 484, 5.1, 484.2, 206/528; 220/359.2
See application file for complete search history.

(56) References Cited

U.S. PATENT DOCUMENTS

| | | | | | |
|---|---|---|---|---|---|
| 3,311,229 | A * | 3/1967 | Troll et al. | ..... | 206/461 |
| 3,414,414 | A * | 12/1968 | Christine et al. | ..... | 426/122 |
| 3,880,285 | A * | 4/1975 | March | ..... | 206/373 |
| 3,921,805 | A | 11/1975 | Compere | | |
| 3,924,748 | A * | 12/1975 | Braverman | ..... | 206/534.1 |
| 4,294,361 | A | 10/1981 | Margulies et al. | | |
| 4,693,371 | A * | 9/1987 | Malpass | ..... | 206/538 |
| 5,203,455 | A * | 4/1993 | Hewelt et al. | ..... | 206/704 |
| 5,339,960 | A * | 8/1994 | Price | ..... | 206/531 |
| 5,873,483 | A * | 2/1999 | Gortz et al. | ..... | 220/269 |
| 5,927,500 | A * | 7/1999 | Godfrey et al. | ..... | 206/531 |
| 5,944,191 | A | 8/1999 | Ray et al. | | |
| 6,161,699 | A * | 12/2000 | Gartland | ..... | 206/531 |
| 6,830,149 | B2 * | 12/2004 | Merboth et al. | ..... | 206/438 |
| 2003/0196925 | A1 * | 10/2003 | Dalessandro | ..... | 206/461 |

FOREIGN PATENT DOCUMENTS

| | | |
|---|---|---|
| GB | 3002309 | 4/2002 |
| GB | 3002310 | 4/2002 |
| GB | 3002243 | 3/2003 |

* cited by examiner

*Primary Examiner*—J. Gregory Pickett
(74) *Attorney, Agent, or Firm*—Peter S. Gilster; Greensfelder, Hemker & Gale, P.C.

(57) ABSTRACT

A container for storing and dispensing consumer products comprises a multi-compartment moulded tray (1) formed with an array of discrete cavities (6) for receiving consumer products. A cover film (20) is secured by adhesive to the generally planar top surface (5) of the tray (1) to retain the one or more items within the cavities (6). The cover film has pre-formed tear lines (23) defining the peripheries of an array of tear-off portions (22), each tear-off portion being arranged so that in use it overlies an associated one of the cavities to retain the one or more items in that cavity until it is removed. Each tear-off portion (22) has an associated lug portion (24) not secured to the tray in use, for gripping by a user preparatory to removing the said tear-off portion (22). The top surface of the tray has an array of upwardly extending protrusions (7) positioned to be located beneath the lug portions (24) in use to bend those lug portions (24) upwardly out of the plane of the remainder of the cover film (20) when the cover film (20) is secured by adhesive to the generally planar top surface of the tray (1), to make the lugs readily graspable by a user.

7 Claims, 5 Drawing Sheets

DISPENSING CONTAINERS

FIELD OF THE INVENTION

The invention relates to containers for storing and dispensing consumer products. The term consumer products is intended to cover a wide variety of products as illustrated by the following (non-exhaustive) list: foods, either for immediate consumption, pre-cooked, prepared or oven ready, including prepared meals, confectionary, hardware and DIY items, cosmetics, seeds, animal and fish feeds, electronic components, medical appliances and dressings, medicines and medication such as pills, tablets and capsules.

The containers may be used in place of conventional blister packs for the packaging of pills, tablets or capsules, or may be used for organising and storing mixed medication for subsequent dispensation according to a predefined dosage regimen. The principle behind such mixed medication containers is that a dosage regimen of mixed medication can be organised in advance for a period of a week or more, and a patient or nurse can then remove from the container, at predefined times over the said period, the one or more pills, tablets and/or capsules to be administered on each occasion according to the dosage regimen.

BACKGROUND ART

Blister packs are of course well known for the storage and dispensing of pills, tablets and capsules, which are stored individually in cavities in a multi-cavity tray and removed by pushing each pill, tablet or capsule through a rupturable film or foil covering the cavities. The film or foil cover may be paper or a plastics film that can be peeled or torn away to expose the medication in the tray cavities, but is generally aluminium foil, which has the dual advantage of being easily rupturable and vapour-impermeable. Such blister packs normally carry only one unit dose of the same medication in each cavity.

Mixed medication blister packs have been proposed, having larger cavities for filling by a pharmacist, wherein each cavity in a multi-cavity tray can be filled with a mixture of medications. Typically, a tray may have a 2×7, 3×7, 4×7 or 5×7 array of cavities corresponding to 2, 3, 4 or 5 predefined medication times per day over a 7-day period, or one dose prescribed per day over a 2, 3, 4 or 5 week period. For example, a 4×7 tray may be filled with the medication to be taken at breakfast-time, lunchtime, early evening and immediately before retiring each day for a week, and then the filled cavities sealed with a rupturable or sequentially removable film or foil cover. Printed instructions on the pack identify the intended sequence of opening the individual cavities to dispense their contents according to the prescribed dosage regimen.

Disadvantages of the above blister packs which use a rupturable foil cover sheet are the difficulty experienced by some patients, particularly the elderly, in pushing the medication, through a foil cover sheet to rupture the cover sheet, the need for expensive laminating equipment to seal an aluminum foil cover sheet over the cavities after initial filling, and the difficulty experienced by the user in selecting the cavity containing the medication to be dispensed if the medication is pushed up through the foil from below. If the wrong cavity is opened, then re-sealing is impossible because the foil has ruptured.

A major disadvantage of the above blister pack using a peelable film cover sheet is the difficulty experienced by the user of peeling or tearing away a single selected portion of the cover sheet to expose the contents of only one preselected cavity. This can be achieved by scraping a finger-nail over a corner or tab portion of a segment of the cover sheet sealing the preselected cavity, but grasping that corner to peel away the complete segment sometimes requires considerable manual dexterity and possibly good eyesight, which may be beyond the abilities of many elderly consumers. Also, if a tacky peelable adhesive is used to adhere the cover sheet to the tray, it is desirable to prevent the contents of the tray from coming into contact with the adhesive. Finally, the film cover sheet may not have as high a vapour impermeability as metal foil, so there is a reluctance on the part of pharmacists to pre-fill a mixed medication blister pack with medication for administration more than seven days in advance of the filling date, lest the medication deteriorates due to storage in humid ambient conditions.

Prepared meals are commonly sold in packaging containers comprising a heat resistant tray and an open-ended sleeve made of a suitable food grade boxboard. The tray is normally scaled with a peelable film or foil cover. A major disadvantage of these packaging containers is the difficulty which consumers car experience when trying to remove the cover. Tie difficulties are particularly acute if the prepared meal has been heated and the packaging container is hot.

SUMMARY OF THE INVENTION

The invention, which aims to remove some or all of the above problems and disadvantages, provides a container for storing and dispensing consumer products, comprising:

- a tray having a generally planar top surface into which has been formed one or more discrete cavities for receiving the consumer products; and
- a cover film to be secured to the generally planar top surface of the tray to seal the one of more cavities to retain the consumer products in the one or more cavities;
- the cover film having pre-formed tear lines defining a tear-off portion corresponding to the periphery of the or each cavity to retain the consumer products in that cavity until it is removed by tearing along its tear lines, the or each tear-off portion of the cover film having an associated lug portion not secured to the tray in use, for gripping by the consumer preparatory to tearing off the said tear-off portion;
- CHARACTERISED IN THAT the top surface of the tray has an upwardly extending protrusion positioned to be located beneath the or each lug portion in use to bend that lug portion upwardly out of the plane of the remainder of the cover film when the cover film is secured to the generally planar top surface of the tray.

Because the or each lug portion is bent up out of the plane of the remainder of the cover firm when the film is stuck down, it can very easily be grasped by the consumer for removal of the tear-off portion.

The cover film is preferably secured to the generally planar top surface of the tray by an adhesive. The adhesive may be a co-adhesive, a pressure contact adhesive, a peelable adhesive or a heat sensitive lacquer, the latter being utilized in a heat-sealing process.

The cover film may be a metal foil, such as aluminium foil, a metallized polymeric film or paper sheet, or a plastics film of single or multiple layer constructions depending on the sort of consumer products to be stored and dispensed from the container. The cover film is preferably non-rupturable so that that the consumer products cannot be accidentally or deliberately pushed through the cover film.

The periphery of the or each tear-off portion is preferably defined by pre-scored or pre-perforated tear lines. The pre-scored tear lines may be created by pressing a knife on to the surface of the cover film so as to cut or score part way through but not fully through the thickness of the cover film. In contrast, the lug portions of the or each tear-off portion can be defined by cut lines extending completely through the material of the cover film around the whole of the periphery of the or each lug portion except for a hinged portion connecting that lug portion to its associated tear-off portion. Then when the cover film is secured to the top surface of the tray, the or each lug portion bends upwardly out of the plane of the remainder of the cover film by pivotal flexure about the hinged portion. If the or each lug portion is defined by pre-scored or pre-perforated tear lines instead of cut lines then when the cover film is secured to the top surface of the tray, the tear lines are broken by the upwardly extending protrusion and the or each lug portion bends upwardly out of the plane of the remainder of the cover film by pivotal flexure about the hinged portion.

If the container is a multi-compartment container used to organise and store mixed medication for subsequent dispensation according to a predefined dosage regimen then the cover film or (if the cover film is transparent) the tray is preferably printed with details of the sequence of the dosage regimen, so that the user can determine the correct sequence of opening and can peel away the individual tear-off portions from above, leaving the medication safely contained in its tray cavity until the opened cavity is inverted to tip out the medication. The individual tear-off portions of the cover film are removed with the generally planar top of the tray facing upwards, so that the risk of spilling the medication onto the floor during opening is much reduced over rupturable foil covered blister packs which are generally opened in the inverted position.

At least the tear-off portions of the cover film preferably have low vapor-permeability so that the medication temporarily encapsulated in the different discrete cavities can be protected from variations in ambient humidity during storage of the medication within the container. Low vapour permeability is also important if the container is used to store and dispense perishable consumer products such as foods.

The tear-off portions of the cover film may be made selectively of low vapour permeability in the areas which in use overlie the cavities by adhered to the bottom of the cover film patches of material with high vapour barrier properties, shaped and sized to overlie the cavities, In the same way, patches can be adhered to the bottom of the lug portions to reinforce the rigidity of the lug portions and to prevent any adhesive applied to the underside of those lug portions from causing the lug portions to adhere to the upwardly extending protrusions of the tray. The above patches beneath the tear-off portions and the lug portions can be created from a single sheet of barrier film as follows. A single sheet of that barrier film is secured to the underside of the cover film by a peelable adhesive. The barrier film has pre-formed tear lines defining the peripheries of the vapour-resistant patches and the lug reinforcement patches, so that peeling away the majority of the barrier film from the cover film immediately prior to application of the cover film to secure it to the generally planar top surface of the tray exposes the peelable adhesive in areas necessary for adhesion to the tray but leaves the patches attached elsewhere to the underside of the cover film.

In a preferred embodiment of the invention, the pre-formed tear lines defining the peripheries of the vapour-resistant patches lie outside the pre-formed tear lines defining the peripheries of the array of tear-off portions such that the vapour-resistant patches are larger than the tear-off portions. Each lug reinforcement patch is connected to its associated vapour-resistant patch by a bridge portion so that when the cover film is secured to the top surface of the tray, the lug reinforcement patches bond upwardly out of the plane of the vapour-resistant patches by pivotal flexure about the bridge portions. By grasping a lug portion and its associated lug reinforcement patch, the user can remove a tear-off portion and its associated vapour resistant patch in a single action so that the item stored in the cavity can be dispensed. This embodiment incorporates tamper-evident properties because once a tear-off portion of the cover film has been removed to expose the contents of the cavity, it cannot be reattached to the generally planar top surface of the tray. This is because the vapour-resistant patch is larger than the tear-off portion to which it is attached and it cannot be easily inserted back through the opening in the cover film. It will be readily appreciated that when a tear-off portion and its associated vapour resistant patch have been removed, there will be a narrow border of the cover film immediately outside the pre-formed tear line defining the periphery of the tear-off portion which was previously attached to the said associated vapour-resistant patch. In practice, because the underside of the cover film is covered with a peelable adhesive, the narrow border will tend to secure itself to the generally planar top surface of the tray. This snakes it almost impossible to slide the whole of the periphery of the vapour-resistant patch back between the cover sheet and the tray. Tamper evident properties are especially important if the container is used to store and dispense medication or food.

The cover film can be secured to the tray using an industrial process. A typical process might involve securing the cover film to the tray using a high-speed, on-line heat seal technique of the kind used to secure the rupturable film or foil to conventional blister packs. The generally planar surface of the tray could then be rolled to push the lug portions down onto the array of upwardly extending protrusions and bend those lug portions upwardly out of the plane of the remainder of the cover film. The rolling can be mechanical or by means of a hand roller, for example.

DRAWINGS

Although the container according to the invention is suitable for storing and dispensing a wide range of consumer products the rest of the specification will concentrate mainly on its use as a multi-compartment container for organising and storing mixed medication for subsequent dispensation according to a predefined dosage regimen.

Figure 1:
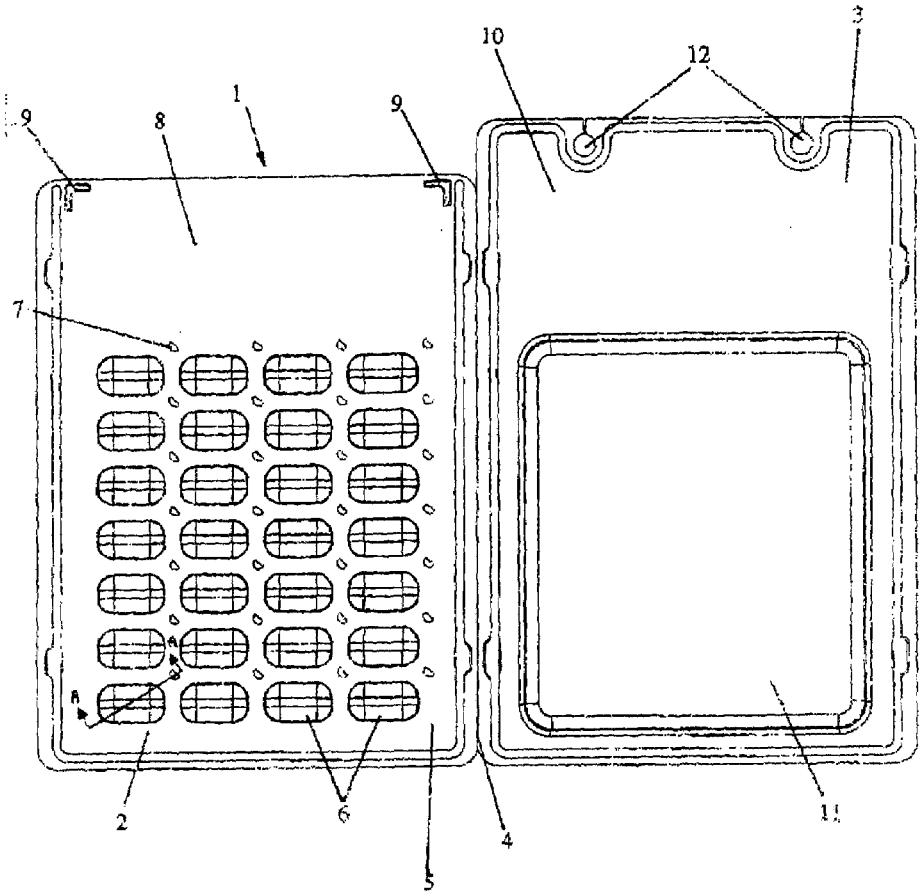
FIG. 1 is a top view of a moulded tray of a multiple-compartment container according to the invention.
Figure 2:
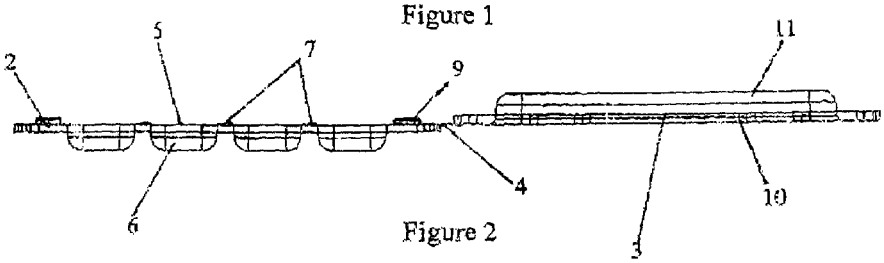
FIG. 2 is a front elevation view of the tray of FIG. 1.

Referring first to FIGS. 1 and 2 there is illustrated a molded tray 1 for use in the creation of a multiple-compartment container according to the invention. The tray 1 is formed from a sheet of thermoplastic material, and may be formed for example by press moulding or by vacuum moulding.

The tray 1 is formed from an upper part 2 and a lower part 3 joined together by an integrally moulded hinge 4. The upper part 2 comprises a generally planar top surface 5 (see FIG. 2) into which has been formed a 4×7 array of discrete cavities 6. It will be readily appreciated that other arrangements of the discrete cavities are possible depending on the particular dosage regimen required.

Figure 6:
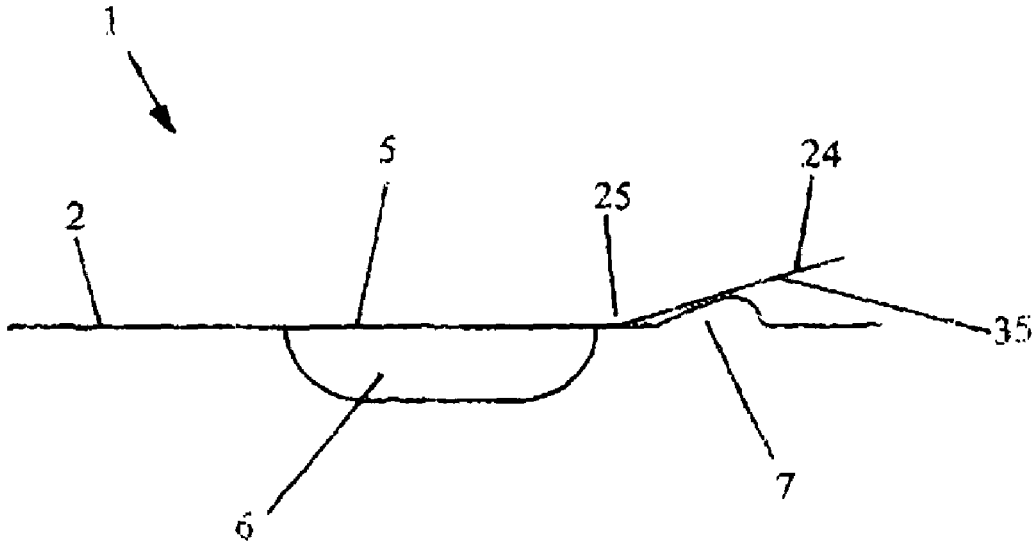
FIG. 6 is a cross-sectional view taken along the line A—A in FIG. 1 but with the cover sheet and barrier sheet of FIGS. 3 to 5 applied to the top surface of the tray.

Upstanding from the generally planar top surface 5 of the upper part 2 is a 4×7 array of upwardly extending protrusions 7, each positioned above and to the right of an associated cavity 6 as viewed in FIG. 1. Each protrusion 7 slopes upwardly from the plane of the top surface 5 in a direction away from the associated cavity 6 as shown in FIG. 6. Each protrusion 7 is generally semicircular in plan view as shown in FIG. 1.

A flat header portion 8 of the upper part 1 immediately above the array of cavities 6 and protrusions 7 is provided for receiving printed information such as a trade mark or a pharmacy label. Close to the top corners of the header potion 8 the upper part of the tray is provided with two upstanding integrally moulded location brackets 9 for the accurate location of a cover sheet in register with the cavities 6 and protrusions 7.

The lower part 3 comprises a generally planar surface 10 (see FIG. 2) into which has been formed a single cavity 11. Two split apertures 12 are provided in the top edge of the lower part 3 so that the tray can be clipped onto a U-shaped wire loop and stacked with other trays prior to the medication being dispensed. In use, the tray 1 is assembled by folding it along the hinge 4 so that the lower part 3 and the upper part 2 come into register on top of each other and the array of cavities 6 formed in the generally planar top surface 5 are received within the single cavity 11. This prevents any pressure on the underside of the tray from accidentally pushing the medication through the cover sheet.

Figure 3:
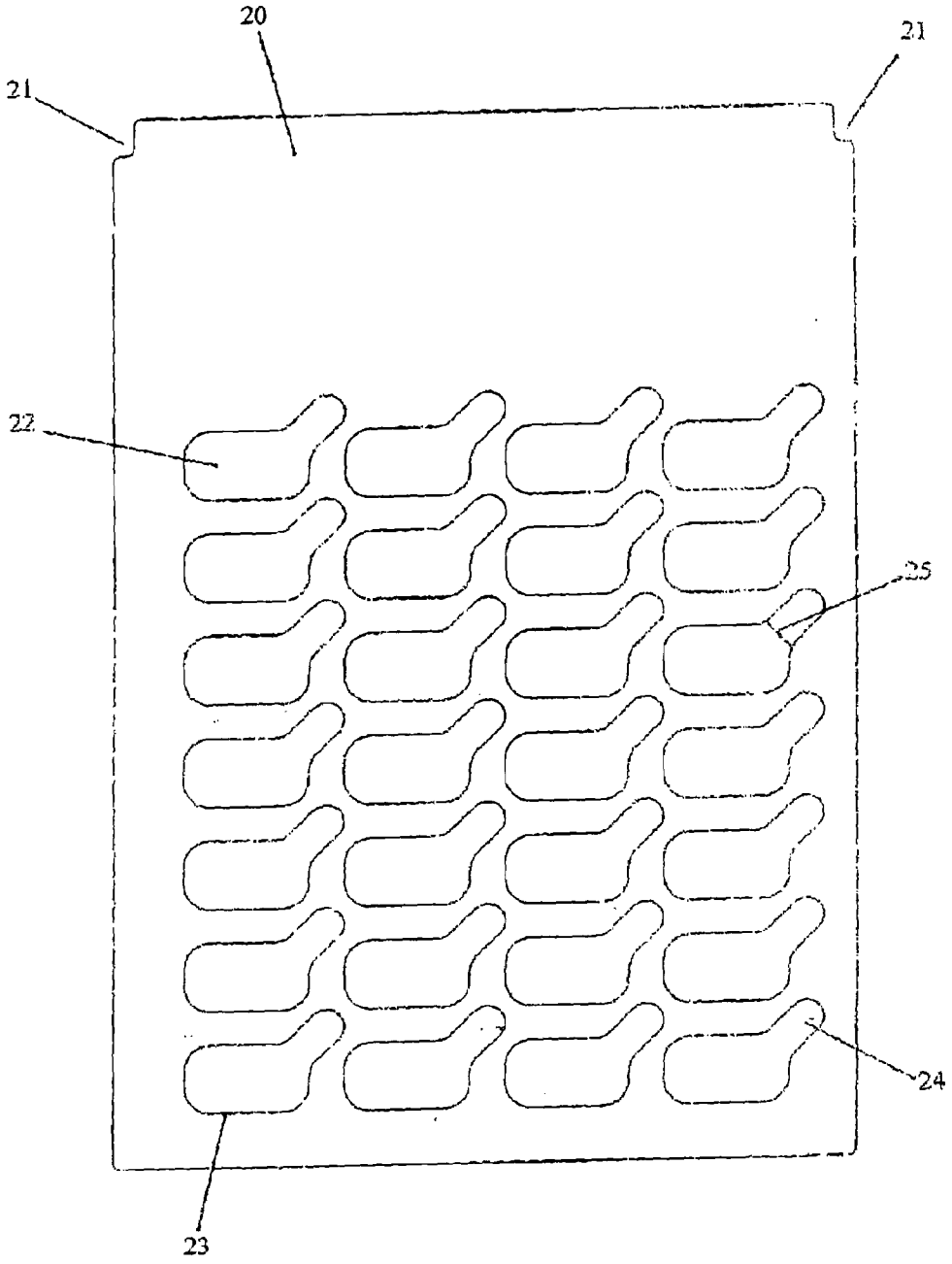
FIG. 3 is a plan view of a cover film for use with the tray of FIGS. 1 and 2 to create a multiple-compartment container according to the invention.
Figure 4:
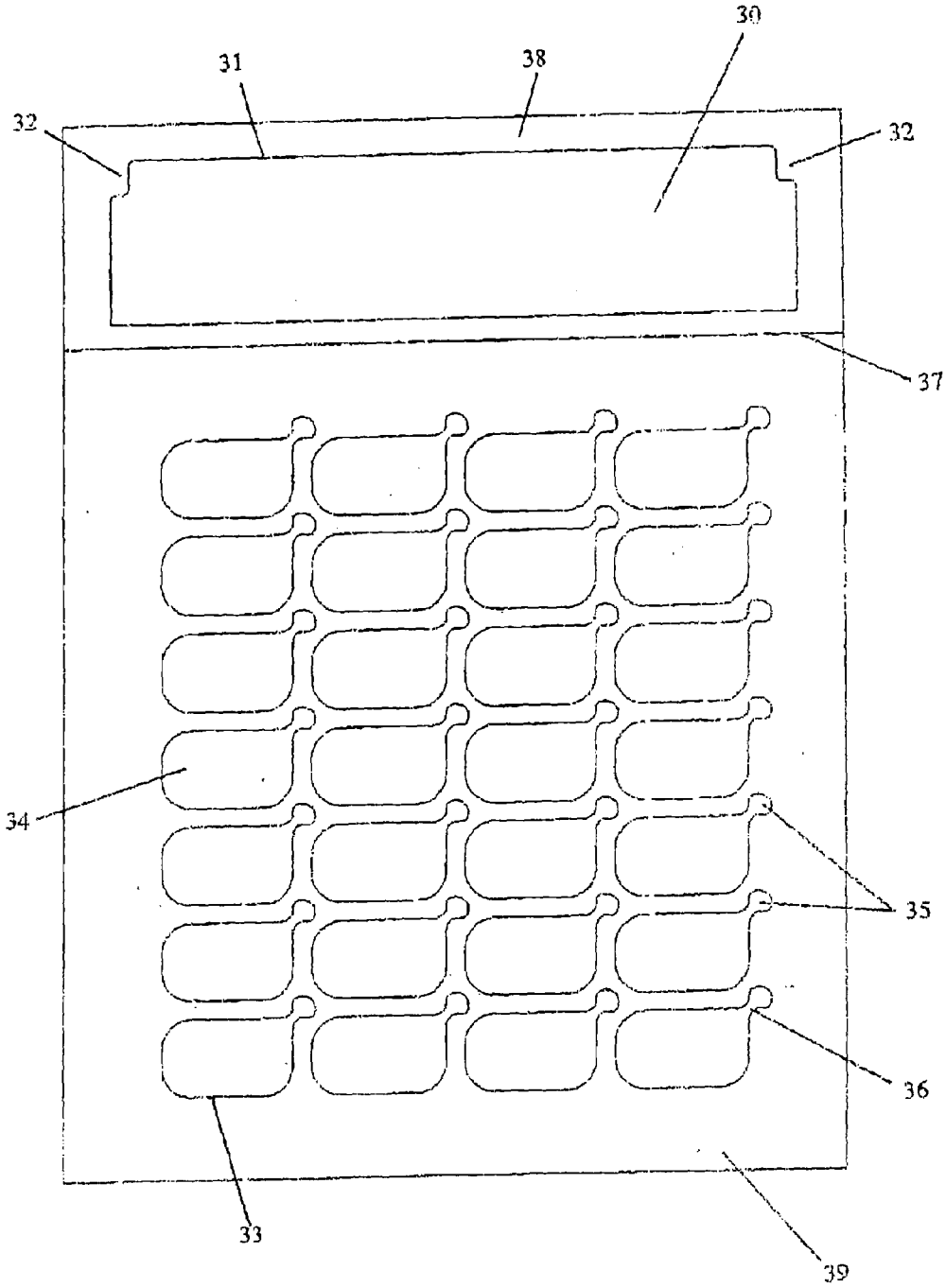
FIG. 4 is a plan view of a sheet of barrier film to be used in conjunction with the cover sheet of FIG. 3 in the creation of a multiple-compartment container according to the invention.
Figure 5:
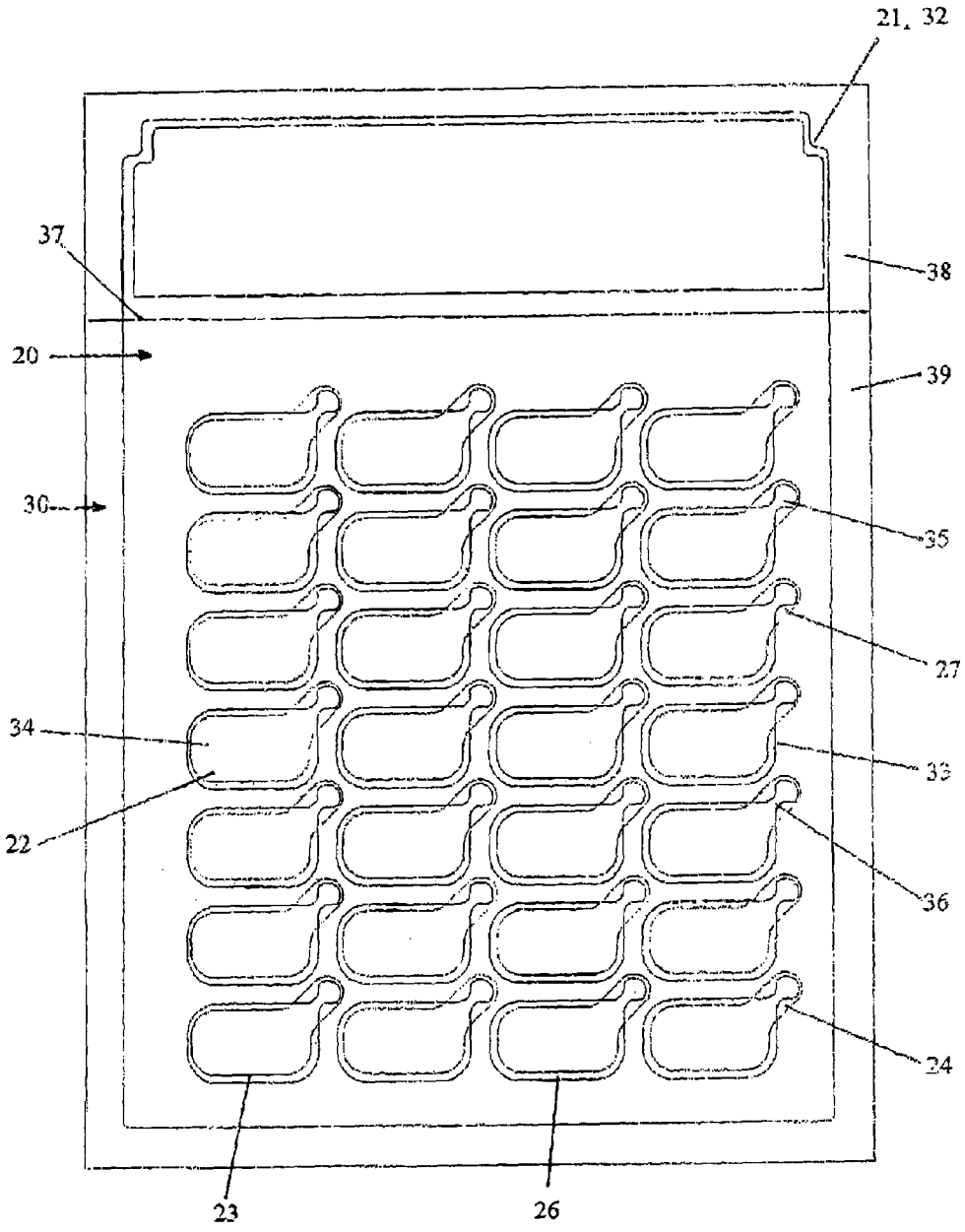
FIG. 5 is a plan view of the sheet of barrier film of FIG. 4 applied to the underside of the cover sheet of FIG. 3 prior to the assembly of the multiple-compartment container according to the invention.

The cover sheet is of a laminated construction, which can be best understood by reference to FIGS. 3 to 5. The top surface of the cover sheet is the sheet 20 shown in FIG. 3. It is a sheet of smooth and flexible, and preferably transparent, plastics film, the outline of which corresponds to the outline shape of the upper part of the tray 1 with which it is to be used. A pair of location rebates 21 formed in the sheet 20 are precisely aligned with the location brackets 9 of the tray 1, for accurate location of the sheet 20 on the tray 1 in precise alignment one with the other.

The sheet 20 comprises it 4×7 array of tear-off portions 22 each of which is defined by a peripheral score line 23 and includes a lug portion 24. The score line 23 is a predefined zone of weakness in the film 20, which in use defines a preferred tear line in the plastics film.

The entire underside of the sheet 20 of FIG. 3 is coated with a peelable adhesive and the sheet 20 is, prior to use, adhered to a barrier sheet 30 as shown in FIG. 4. The barrier sheet 30 has a score line 31 defining two locating rebates 32, which in use register with the locating rebates 21 of the sheet 20. Score lines 33 define the outer peripheries of a 4×7 array of vapour-impermeable patches 34, which in use are adhered to the respective tear-off portions 22 of FIG. 3 and lie directly over the respective cavities 6 of FIGS. 1 and 2. Each vapour-impermeable patch 34 is joined to a reinforcement patch 35 by means of a flexible bridge portion 36. The reinforcement patches 35 in use adhere to the undersides of the lugs 24 of FIG. 3 to reinforce and stiffen the lugs. The vapour-impermeable patches 34 are larger than the tear-off portions 22 but the reinforcement patches 35 are the same size or slightly smaller than the lugs 24.

It can be clearly seen from FIG. 5 that when the plastics film sheet 20 of FIG. 3 is placed over the sheet 30 of the barrier film of FIG. 4 and adhered to the barrier sheet 30 with the locating rebates 21 and 32 in register, each tear-off portion 22 has a pitch 34 with low vapour transmission properties and a reinforcing patch 35 under each lug 24.

A further score line 37 is formed across the top of the barrier sheet, beneath the locating rebates 32, to define a tear-off strip 38 along the top edge of the barrier sheet 30.

In use, a pharmacist or a carer, or the patient himself or herself will distribute medication in the form of tablets and/or capsules between the 28 cavities 6 of the tray 1 in accordance with a 7-day or 28-day regimen. For example, the seven rows of cavities 6 represent the seven days of the week, and the for columns can represent either four consecutive weeks of a 28 day dosage cycle, or four different dosage times for each day of treatment. In the latter case, the first column can represent breakfast, the second column lunchtime, the third column early evening and the fourth column bedtime. Either a uniform medication can be distributed through the 28 cavities, or a varying mixture of medications can be put into each cavity.

When the cavities have been properly filled, the assembled cover sheet and backing sheet of FIG. 5 is placed over the tray and aligned with the tray placing the locating rebates 21 and 32 of the cover sheet and backing sheet next to the location brackets 9 of the tray. Holding the cover sheet and backing sheet 20, 30 in position with one hand, the tear-off strip 38 of the backing sheet can be pealed away, with the rebates 21 in the cover sheet 20 returning to locate adjacent the location brackets 9 to maintain the alignment of the cover sheet 20 over the tray. The adhesive on the underside of the cover sheet 20 firmly anchors the top edge of the cover sheet 20 to the tray 1. At that stage, without moving the tray 1 and without disturbing the contents of the cavities 6, a main portion 39 of the barrier film 30 can then be peeled away from under the cover sheet 20 so as to expose the adhesive on the underside of the cover sheet 20 and permit it to be adhered to the generally planar top surface 5 of the tray 1. During the peeling away of the main portion 39, the barrier sheet 30 tears around the score lines 33, leaving the patches 34 and 35 still adhered to the underside of the cover sheet 20.

As the cover sheet 20 is smoothed down and adhered to the substantially planar top surface 5 of the tray 1, the lugs 24 come into contact with the projections 7 of the tray. The score lines 23 tear around the lugs 24 so that the lugs can flex upwardly around zones of flexure or hinge areas 25 (one of which is shown dotted in FIG. 3). The flexible bridges 36 also allow the reinforcing patches 35 to flex upwardly with the lugs 24. The lug portions 24 are thus bent upwardly out of the plane of the remainder of the cover film 20, so that they can very easily be grasped between thumb and forefinger when the time is right to remove the associated tear-off portion 22 and dispense the medication in the associated cavity. The reinforcing patch 35 beneath each lug 24 stiffens the lug 24 and helps the stiffened lug to point upwardly at an angle to the remainder of the cover film 20 even when the edge of each lug 24 remote from its associated tear-off portion 22 extends in cantilever beyond the edge of the associated protrusion 7 as clearly shown in FIG. 6.

It will be appreciated that the tear-off portions 22 and the vapour-impermeable patches 34 are not adhered to the substantially planar top surface 5 of she tray but are held in place by the periphery of the cover sheet 20.

The multi-compartment container incorporates a tamper-evident feature to make sure that no one can interfere with the stored medication before it is properly dispensed. The tamper-evident feature arises from the fact that the vapour-impermeable patches 34 are larger than the tear-off portions 22. When a lug portion 24 is grasped between thumb and forefinger, the reinforcing patch 35 will also be grasped. Further movement of the lug portion 24 away from the generally planar top surface 5 of the tray 1 will cause the score line 23 in the cover sheet 20 to break and free the tear-off portion 22. However, to fully release the tear-off portion 22 the vapour-impermeable patch 34 must also be peeled away from the overlapping region 26 of the cover sheet 20 surrounding the tear-off portion 22 (see FIG. 5). Once the tear-off portion 22 aid vapour-impermeable patch 34 have been completely removed, the overlapping region 26 of the cover sheet 20 will, in practice, adhere to the generally planar top surface 5 of the tray of its own accord. It will therefore be appreciated, that the tear-off portion 22 cannot be reattached to the tray 1 because the vapour-impermeable patch 34 which is adhered to the underside of the tear-off portion 22 is larger than the aperture overlying die cavity 6 and it is impossible to slide the vapour-impermeable patch back between the cover sheet 20 and the tray 1 because the overlapping region 26 will have adhered itself to the generally planar top surface 5 of the tray 1. The score lines 23 define a periphery of the tear-off portions 22 which is the same size, or slightly smaller, than the opening of the cavities 6 in the tray. Therefore, even if the vapour-impermeable patch 34 is peeled away from the tear-off portion 22 there is nothing to adhere the tear-off portion to.

It can be seen from FIG. 3 that the flexible bridges 36 which connect the reinforcing patches 35 to the vapour-impermeable patches 34 are narrow in comparison to the lug portions 24 of the tear-off portions 22. This means that a portion 27 of the underside of the lug portions 24 can be adhered to the planar top surface 5 of the tray 1. This does not prevent the lugs 24 from being able to flex upwardly out of the plane of the remainder of the cover sheet 20 but helps to eliminate any vapour penetration under the reinforcing patches 35 of the backing sheet 22 and into the cavities 6.

Printed instructions to the user concerning the timing of the different cavities can be printed on the tray 1 (if the cover film is transparent) or on the cover film 20. Similarly printing to identify the manufacturer of the multiple-compartment container or the pharmacy, or the patient can be printed on the header portion 8 of the tray or on the cover film 20, which overlies that portion.

Pharmacy regulations prohibit the removal of the tray 1 once it has been clipped to the U-shaped wire loop. Therefore, once the tear-off portion 24 has been removed, the medication stored within the particular cavity 6 can be easily dispensed by folding the upper part 2 of the tray over along the hinge 4 so that the array of cavities 6 are pointing downwards.

The invention claimed is:

1. A multiple-compartment container for containing and dispensing medication according to a pre-defined dosage regimen, comprising:

a tray having a generally planar top surface into which has been formed an array of discrete cavities for receiving the medication; and a cover film to be secured to the generally planar top surface of the tray to seal the array of cavities to retain the medication in the array of cavities;

wherein the cover film is adhered to the top surface of the tray by a peelable adhesive applied to the underside of the cover film;

CHARACTERISED IN THAT the cover film has pre-formed tear lines defining the peripheries of an array of tear-off portions, each tear-off portion being arranged so that in use it lies over an associated one of the cavities to retain the medication in that cavity until it is removed by tearing along its tear lines, the respective tear-off portion of the cover film having an associated lug portion not secured to the tray in use, for gripping by a consumer preparatory to tearing off the said tear-off portion;

wherein the tear-off portions of the cover film have low vapour transmission properties in the areas which in use overlies the cavities, those low vapour transmission properties being created by patches with high vapour barrier properties shaped and sized to overlie the cavities and adhered to the underside of the cover film by the same layer of peelable adhesive as that which in use adheres the cover film to the top surface of the tray;

wherein the patches are larger than the tear-off portions;

FURTHER CHARACTERISED IN THAT the top surface of the tray has an upwardly extending protrusion positioned to be located beneath the respective lug portion in use to bend that lug portion upwardly out of the plane of the remainder of the cover film when the cover film is secured to the generally planar top surface of the tray.

2. A container according to claim 1, wherein the patches extend under the lug portions and are adhered to the underside of the lug portions by the same layer of peelable adhesive as that which in use adheres the cover film to the top surface of the tray.

3. A container according to claim 2, wherein the cover film prior to application to secure it to the generally planar top surface of the tray to retain the items within the discrete cavities has over the whole of its underside a sheet of barrier film secured thereto by the peelable adhesive, the barrier film having pre-formed tear lines defining the peripheries of the high vapour barrier patches, so that peeling away the majority of the barrier film immediately prior to application of the cover film to secure it to the generally planar top surface of the tray exposes the peelable adhesive in areas necessary for adhesion to the tray but leaves the patches attached elsewhere to the underside of the cover film.

4. A container according to claim 3, wherein the sheet of barrier film has a further pre-formed tear line close to one edge thereof to define a tear-off portion which when removed exposes a location anchorage area of the peelable adhesive on the underside of the cover film, for adhering an edge portion of the cover film to an edge portion of the tray before peeling away the majority of the barrier film and adhering it over the tray cavities.

5. A container according to claim 4, wherein the tray has upstanding cover sheet location projections formed thereon to be cooperatively received by the cover sheet, providing accurate location of the cover sheet over the tray with the tray cavities and cover sheet tear-off portions in register before adhering the cover sheet to the tray.

6. A container according to claim 1, wherein the cover film is a metal foil, a metallized polymeric film or paper sheet, or a plastics film of single or multiple layer construction.

7. A container according to claim 1, wherein the cover film is non-rupturable.

* * * * *